US006299685B1

(12) United States Patent
Siler et al.

(10) Patent No.: US 6,299,685 B1
(45) **Date of Patent: *Oct. 9, 2001**

(54) WEB PROCESSING WITH ELECTROSTATIC MOISTENING

(75) Inventors: Steven J. Siler, Cary, IL (US); David M. Klein, Fontana, WI (US)

(73) Assignee: Hurletron, Incorporated, Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/502,727

(22) Filed: Feb. 11, 2000

(51) Int. Cl.[7] ..... B05C 3/12; B41F 5/06

(52) U.S. Cl. ..... 118/58; 118/325; 101/488

(58) Field of Search ..... 118/300, 620, 118/621, 627, 629, 58, 68, 69, 67, 642, 643, 325; 101/488

(56) References Cited

U.S. PATENT DOCUMENTS

| | | | |
|---|---|---|---|
| 2,221,338 | 11/1940 | Wintermute | 91/8 |
| 2,333,220 | 11/1943 | Weiss | 101/152 |
| 2,408,498 | 10/1946 | Welk | 101/416 |
| 2,421,787 | 6/1947 | Helmuth | 117/93 |
| 2,464,119 | 3/1949 | Dawson | 34/155 |
| 2,677,626 | 5/1954 | Bodle et al. | 117/93 |
| 2,729,191 | 1/1956 | Ransburg | 118/51 |

(List continued on next page.)

FOREIGN PATENT DOCUMENTS

| | | | |
|---|---|---|---|
| 2219994 | 11/1973 | (DE) | B05B/5/02 |
| 2812881 | 10/1978 | (DE) | B05B/5/08 |
| 2841395 | 3/1980 | (DE) | B05B/5/08 |
| 32 07 463 A1 | 9/1983 | (DE) | 101/424.1 |
| 31 15958 | 12/1983 | (DE) . | |
| 36 43 380 | 6/1991 | (DE) . | |
| 42 27 136 | 2/1994 | (DE) . | |
| 44 05 332 | 8/1995 | (DE) . | |
| 131182 | 1/1985 | (EP) | B05B/5/02 |
| 233723 | 8/1987 | (EP) | B05B/5/08 |
| 2386356 | 4/1978 | (FR) | B05B/5/02 |
| 923684 | 4/1963 | (GB) . | |
| 1 588 104 | 4/1981 | (GB) | B05B/5/02 |
| 2 102 344 A | 2/1983 | (GB) | 101/488 |
| 43-23851 | 10/1968 | (JP) . | |

(List continued on next page.)

OTHER PUBLICATIONS

Product brochure entitled "The New Electrostatic Remoistening Unit Eltex LG50", 4 pages (prior art).

Eltex brochure Figs. 16–18, 3 pages (prior art).

EPO Publication of Abstract of Japanese 61–206655 published Dec. 9, 1986.

*Primary Examiner*—Richard Crispino
*Assistant Examiner*—Yewebdar T Tadesse
(74) *Attorney, Agent, or Firm*—Marshall, Gerstein & Borun

(57) ABSTRACT

An apparatus for processing a web of material by applying a liquid material to the web, heating the web, cooling the web and moistening the web is provided with an applicator that applies the liquid material to the web, a drying apparatus that heats the web to an initial temperature of greater than about 250° F. and causes the web to have a moisture content of no greater than about 1.5%, a first cooling apparatus that causes the initial temperature of the web to be reduced to a second temperature no greater than about 210° F. and no less than about 100° F., a moistening apparatus that causes the moisture content of the web to be increased to at least about 2.5%, and a second cooling apparatus that causes the web to be cooled to a temperature not greater than about 100° F. The moistening apparatus includes a generator adapted to generate a directed electrostatic field through which the web passes and a sprayer adapted to spray liquid through the electrostatic field and onto the web when the temperature of the web is between about 210° F. and 100° F.

5 Claims, 6 Drawing Sheets

U.S. PATENT DOCUMENTS

| | | | |
|---|---|---|---|
| 2,733,171 | 1/1956 | Ransburg | 117/93 |
| 2,794,751 | 6/1957 | Juvinall | 117/93 |
| 2,877,137 | 3/1959 | Juvinall | 117/93 |
| 2,894,175 | 7/1959 | Lamm | 317/3 |
| 3,076,124 | 1/1963 | Viscardi | 317/2 |
| 3,318,018 | 5/1967 | Steele et al. | 34/62 |
| 3,323,934 | 6/1967 | Point | 117/17 |
| 3,402,697 | 9/1968 | Kock | 118/624 |
| 3,467,541 | 9/1969 | Aronsson et al. | 117/93.4 |
| 3,476,082 | 11/1969 | Cowles | 118/635 |
| 3,484,275 | 12/1969 | Lewicki, Jr. | 117/93.4 |
| 3,578,486 | 5/1971 | Fenton | 117/93.41 |
| 3,625,743 | 12/1971 | Watanabe | 117/93.4 |
| 3,656,455 | 4/1972 | Watanabe | 118/630 |
| 3,676,194 | 7/1972 | Probst | 117/93.4 |
| 3,757,491 | 9/1973 | Gourdine | 55/107 |
| 3,930,614 | 1/1976 | Krenkel | 239/15 |
| 4,219,864 | 8/1980 | Grunenfelder et al. | 361/228 |
| 4,567,673 | 2/1986 | Bëhnensieker | 101/424.1 |
| 4,689,895 | 9/1987 | Taylor et al. | 321/20 |
| 4,702,015 | 10/1987 | Taylor et al. | 34/20 |
| 4,859,266 | 8/1989 | Akasaki et al. | 156/273.1 |
| 4,939,992 | 7/1990 | Bird | 101/183 |
| 5,056,431 | 10/1991 | Sainio | 101/219 |
| 5,184,555 | 2/1993 | Quadracci et al. | 101/424.1 |
| 5,275,103 | 1/1994 | Hahne | 101/488 |
| 5,502,788 | 3/1996 | Plastch | 392/424 |
| 5,596,930 | 1/1997 | Keller et al. | 101/483 |
| 5,642,671 | 7/1997 | Winheim | 101/424.1 |
| 5,669,158 | 9/1997 | Murray et al. | 34/393 |
| 5,881,647 | 3/1999 | Siler et al. | 101/488 |
| 6,076,466 * | 6/2000 | Siler et al. | 101/488 |

FOREIGN PATENT DOCUMENTS

| | | |
|---|---|---|
| 43-23852 | 10/1968 | (JP) . |
| 44-32207 | 12/1969 | (JP) . |
| 48-41445 | 12/1973 | (JP) . |
| 53-12004 | 7/1976 | (JP) . |
| 58-62644 | 4/1983 | (JP) . |
| 60-247559 | 12/1985 | (JP) . |

* cited by examiner

WEB PROCESSING WITH ELECTROSTATIC MOISTENING

BACKGROUND OF THE INVENTION

The invention is directed to apparatus and methods for applying liquid materials to a web and further processing the web by application of additional liquid material to the web through an electrostatic field.

Conventional web-offset printing presses utilize heat-settable ink that is set or cured by heat after the ink is printed onto a paper web. The curing of the ink is typically done by passing the web through a dryer, which causes the temperature of the web to be raised to a relatively high temperature, such as in the range of 250° to 320° F. (Fahrenheit). After it passes from the dryer, the hot web must be cooled to allow effective processing of the web in subsequent operations.

FIG. 1 schematically illustrates a prior art web-offset printing press 10 of the type described generally above. Referring to FIG. 1, the prior art printing press 10 incorporates a plurality of rotatable printing cylinders 12, 14, each of which applies an image to a paper web 16 using a heat-settable ink. The paper web 16, which is guided by a number of rollers 18, passes through the printing press 10 from left to right, as indicated by the arrow shown in FIG. 1.

After the ink is applied by the printing cylinders 12, 14, the web 16 is passed through a dryer 20, which sets the ink by raising the temperature of the web 16 to a relatively high temperature. After passing through the dryer 20, the web 16 is passed over a plurality of chill rolls 22 to cool the web 16. Heat from the web 16 is absorbed by relatively cool water which is piped through the chill rolls 22. After passing through all of the chill rolls 22, the web 16 is at or close to (within 10° F.) room temperature.

After being heated by the dryer 20 and cooled by the chill rolls 22, the paper web 16 has very little moisture content. Consequently, after being cooled by the chill rolls 22, the web 16 is fed to an electrostatic remoistener 24 which adds moisture back to the web 16. The remoistener 24 is provided with a plurality of spray nozzles (not shown) for spraying water droplets onto the paper web 16 and a plurality of field directors (not shown) on each side of the web 16 for generating a directed electrostatic field. The field directors on one side of the web 16 are maintained at a high voltage relative to the field directors on the other side of the web 16, and water is sprayed through the electrostatic field so that the water droplets travel within a confined path between the spray nozzles and the paper web 16.

SUMMARY OF THE INVENTION

The invention is directed to an apparatus for processing a web of material by applying a liquid material to the web, heating the web, cooling the web and moistening the web. The apparatus includes an applicator that applies the liquid material to the web, a drying apparatus that heats the web to an initial temperature of greater than about 250° F. and causes the web to have a moisture content of no greater than about 1.5%, a first cooling apparatus that causes the initial temperature of the web to be reduced to a second temperature no greater than about 210° F. and no less than about 100° F., a moistening apparatus that causes the moisture content of the web to be increased to at least about 2.5%, and a second cooling apparatus that causes the web to be cooled to a temperature not greater than about 100° F. The moistening apparatus includes a generator adapted to generate a directed electrostatic field through which the web passes and a sprayer adapted to spray liquid through the electrostatic field and onto the web when the temperature of the web is between about 210° F. and 100° F.

The electrostatic field generator may be composed of a plurality of first field directors disposed on a first side of the web, each of the first field directors having a plurality of electrodes, a plurality of second field directors disposed on a second side of the web opposite the first side, each of the second field directors having a plurality of electrodes, and a voltage supply that supplies a relatively high voltage to the electrodes of one of the first or second field directors.

The invention is also directed to a method of processing a web that includes the steps of: (a) applying a liquid material to the web, (b) heating the web to a temperature of at least about 250° F. and to cause the web to have a moisture content of no greater than about 1.5%, (c) cooling the web to a temperature of no greater than about 210° F. and no less than about 100° F., (d) generating a directed electrostatic field, (e) causing the web to pass through the directed electrostatic field, (f) spraying liquid through the directed electrostatic field and onto the web when the web has a temperature of between about 210° F. and 100° F. to cause the web to have an increased moisture content of at least about 2.5%, and (g) further cooling the web to cause the web to have a temperature of no greater than about 100° F.

In the above apparatus and method, the liquid material may be applied evenly to the web by an applicator to create a substantially uniform coating of the liquid material on the web, or alternatively, the liquid material may be applied as ink by a plurality of printing cylinders of a printing press.

The features and advantages of the present invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
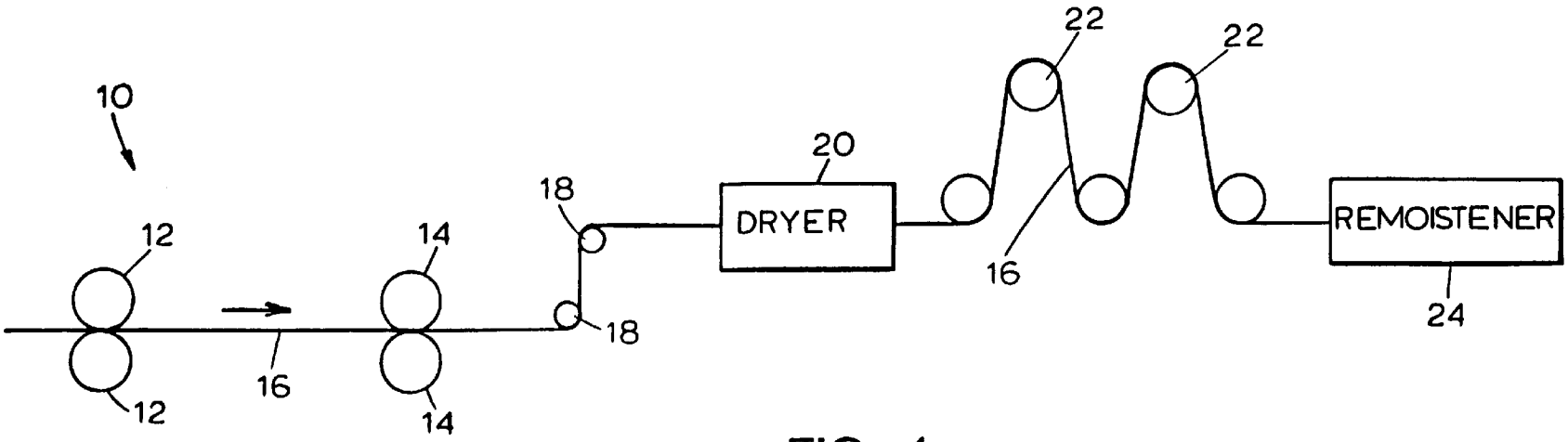
FIG. 1 PRIOR ART
FIG. 1 is a block diagram of a prior art printing press.
Figure 2:
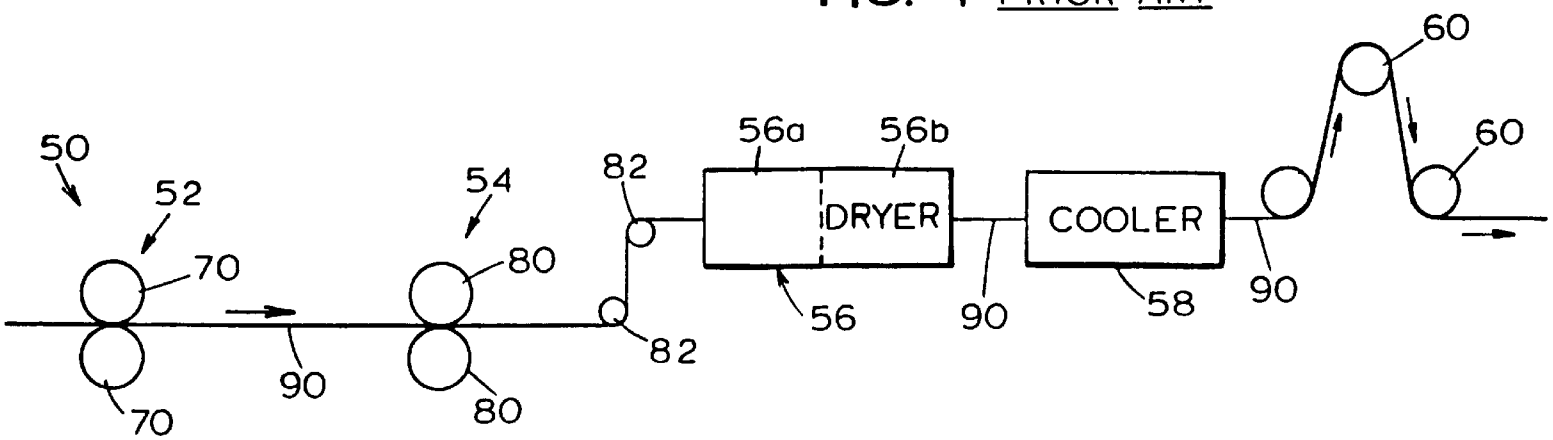
FIG. 2 is a block diagram of a preferred embodiment of a printing press in accordance with the invention.

FIG. 2 illustrates an embodiment of a web-offset printing press 50. Referring to FIG. 2, the printing press 50 has a first printing station 52, a second printing station 54, a dryer 56, a first cooling station in the form of an electrostatic cooler 58 positioned directly adjacent the dryer 56, and an optional second cooling station in the form of a plurality of chill rolls 60.

The first printing station 52 includes a pair of rotatable printing cylinders 70, the second printing station 54 includes a pair of rotatable printing cylinders 80, and the printing press 50 includes a plurality of guide rollers 82. It should be understood that while only two printing stations are shown, a multi-color printing press typically has at least four printing stations, each of which prints images on the web 90 in a different color.

A portion of a web 90, such as paper, is shown to pass successively from the first printing station 52, to the second printing station 54, to the dryer 56, to the electrostatic cooler 58 and to the chill rolls 60, in the direction indicated by the arrows. During printing, as the web 90 passes through the first printing station 52, images in a heat-settable ink of a first color are applied to both sides of the web 90 by the printing cylinders 70. As the web 90 passes through the second printing station 54, images in a heat-settable ink of a second color are printed on both sides of the web 90 by the printing cylinders 80 in alignment or registration with the images previously printed by the cylinders 70.

After being printed by the printing stations 52, 54, the web 90 passes through the dryer 56, which sets the ink by raising the temperature of the web 90 to a relatively high temperature, such as 300° F. From the dryer 56, the web 90 passes directly into the electrostatic cooler 58, which cools the web 90 to a temperature much lower than 300°, such as a temperature between about 80° and 120° F., for example. If its temperature is substantially greater than room temperature when the web 90 exits the electrostatic cooler 58, the web 90 may be passed over one or more optional chill rolls 60 to further lower the temperature of the web 90 to a temperature at or near room temperature.

Figure 3:
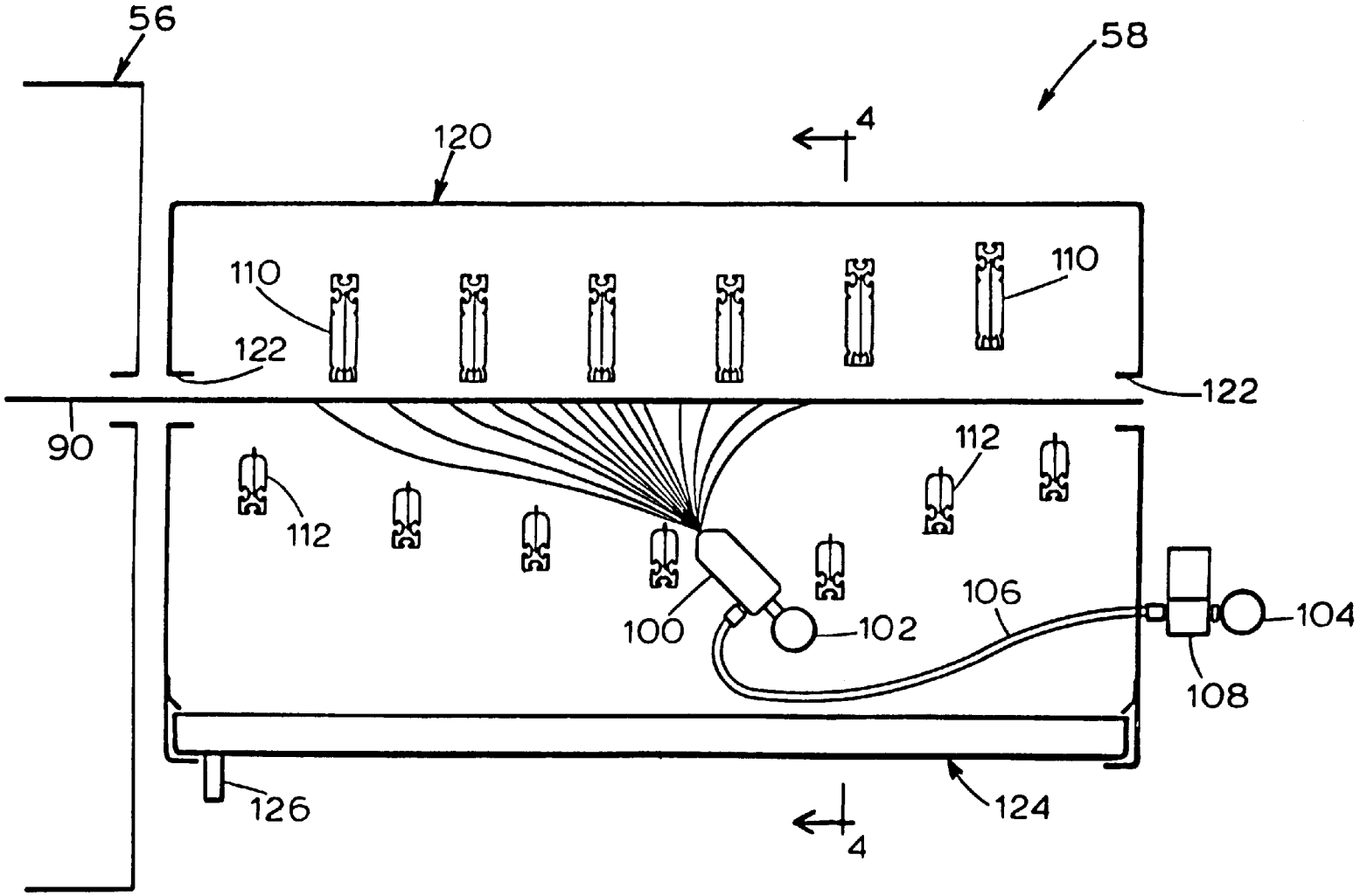
FIG. 3 is a side view of the electrostatic cooler shown schematically in FIG. 2.
Figure 4:
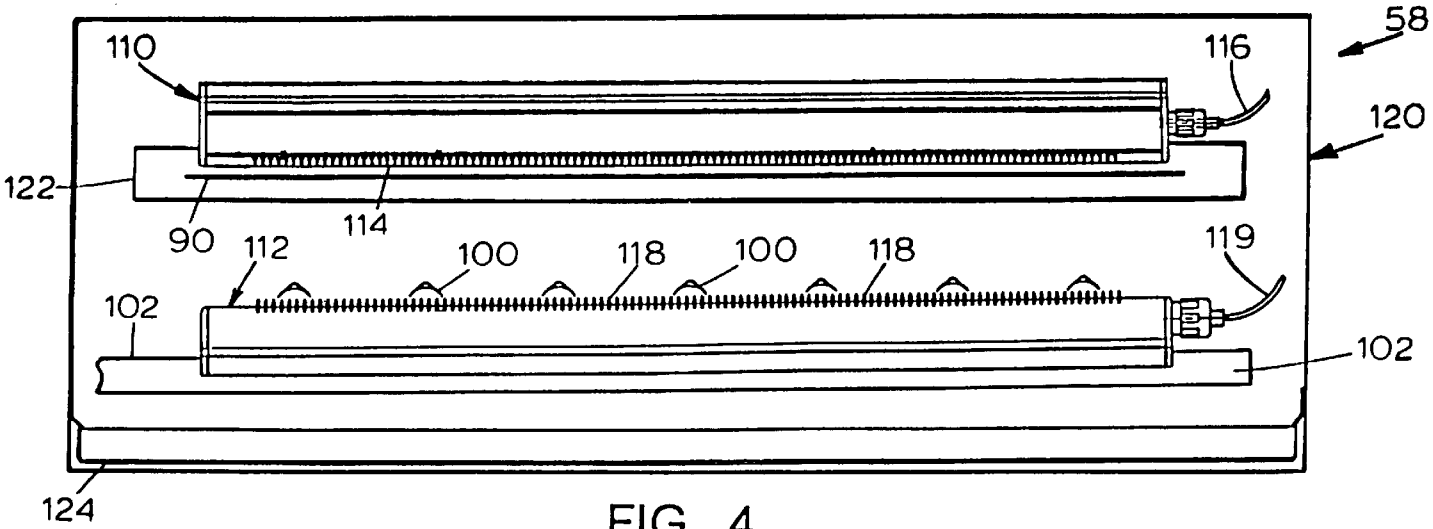
FIG. 4 is a cross-sectional view of the electrostatic cooler taken along lines 4—4 of FIG. 3.

FIG. 3 is a side view of the internal structure of the electrostatic cooler 58 and a portion of the dryer 56 shown schematically in FIG. 2, and FIG. 4 is a side view of the internal structure of the electrostatic cooler 58 taken along lines 4—4 in FIG. 3. Referring to FIGS. 3 and 4, the electrostatic cooler 58 has a plurality of atomizing spray nozzles 100 that are aligned in a direction generally transverse to the longitudinal axis of the web 90. The nozzles 100, which are used to spray very fine water droplets onto the underside of the web 90, are fluidly connected to a source of water in the form of a water header pipe 102 and a source of air in the form of an air header pipe 104 via a hose 106 and an electro-pneumatic valve 108.

The electrostatic cooler 58 has a plurality of upper field directors 110 positioned above the web 90 and a plurality of lower field directors 112 positioned below the web 90. As shown in FIG. 4, the field directors 110, 112 are generally in the form of elongate bars which extend transversely to the longitudinal axis of the web 90.

Each of the upper field directors 110 is provided with row of sharply pointed metal electrodes 114 (see also FIG. 5) which are connected to a relatively high voltage, such as +/−20,000volts or more, via a cable 116 electrically connected to the pointed electrodes 114, and each of the lower field directors 112 is provided with a similar row of sharply pointed electrodes 118, which are connected to electrical ground via a cable 119.

Because of the relatively high voltage across the pointed electrodes 114, 118 of the upper and lower field directors 110, 112, an electrostatic field is created within the electrostatic cooler 58. Both the web 90 and the water droplets sprayed by the spray nozzles 100 pass through the electrostatic field, which is well-defined since multiple field directors 110, 112, each having evenly spaced pointed electrodes 114, 118, are used above and below the web 90.

That electrostatic field effectively confines the path of the water droplets to a well-defined area between the spray nozzles 100 and the web 90 and prevents or minimizes the occurrence of stray water droplets or mist. Consequently, substantially all of the water droplets that are sprayed end up on the web 90 and contribute to the cooling of the web 90, and do not escape from the electrostatic cooler 58.

The electrostatic cooler 58 has a housing or cabinet 120 which substantially encloses the spray nozzles 100 and the upper and lower field directors 110, 112. The cabinet 120 has a pair of rectangular slots 122 formed therein to accommodate passage of the web 90 through the cooler 58, and the cabinet 120 has a lower cabinet portion 124 with a built-in drain 126 to facilitate drainage of any water that leaks from the water header pipe 102 or the nozzles 100.

Figure 7:
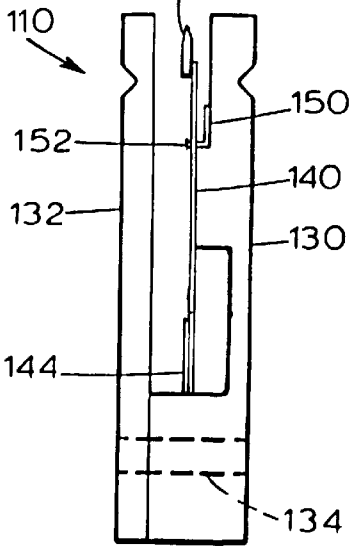
FIG. 7 is an end view of a field director used in the electrostatic cooler.
Figure 6:
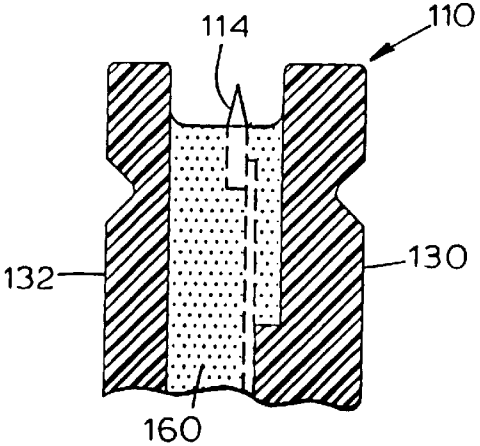
FIG. 6 is a cross-sectional end view of a portion of a field director used in the electrostatic cooler.
Figure 5:
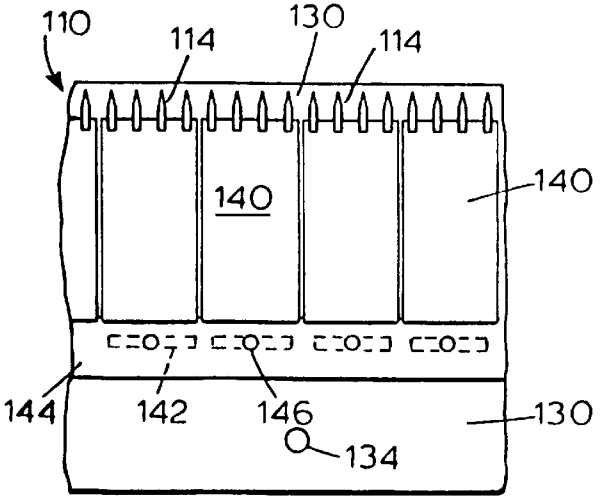
FIG. 5 is a side view of a portion of a field director used in the electrostatic cooler.

The structure of the upper field directors 110 is shown in more detail in FIGS. 5–7. Referring to those figures, the upper field directors 110 have a generally U-shaped dielectric housing formed of a first housing portion 130 and a second housing portion 132 which is mounted to the first housing portion via bolts (not shown) which pass through a number of bores 134 periodically spaced along the length of the housing portions 130, 132.

As shown in FIG. 5, the pointed electrodes 114 are mounted to a plurality of conventional electrode plates 140, which are commercially available from Metallux. Each plate 140, which is composed of a ceramic material, has four of the pointed electrodes 114 mounted to it. The four electrodes 114 on each plate 140 are conductively interconnected by a metallized path (not shown), which is in turn conductively connected to a serpentine resistive path (not shown) plated onto each electrode plate 140. The serpentine resistive path of each plate 140 is conductively connected to a relatively small rectangular metal terminal 142 mounted on each plate 140.

A metal bar 144 is used to conductively interconnect the electrode plates 140. The metal bar 144 has a plurality of circular holes 146 formed therein, the holes 146 being spaced to coincide with and overlap the rectangular terminals 142 of the electrode plates 140. Each of the rectangular terminals 142 may be conductively connected to the metal bar 144 by solder disposed in each of the holes 146.

The spacing of the electrode plates 140 may be fixed by an elongate, metal or plastic spacer strip 150 (FIG. 7) that runs the length of each upper field director 110. The spacer strip 150 may have periodically spaced tabs 152 between which the electrode plates 140 are disposed.

As shown in FIG. 6, a potting material 160 occupies the interior portion of the U-shaped housing of the upper field directors 110. The potting material 160 covers all the internal components of the upper field directors 110 except the very tips of the electrodes 114 (the potting material 160 is not shown in FIGS. 5 and 7 so that the internal structure of the upper field directors 110 is more readily apparent).

The lower field directors 112 are generally similar in construction to the upper field directors 110 described above, except that the lower field directors 112 do not have the electrode plates 140 since no electrical resistance is needed in the lower field directors 112 due to their connection to electrical ground. Also, the spacing of the pointed electrodes 114 of the upper field directors 110 may be different than the spacing of the pointed electrodes 118 of the lower field directors 112. For example, the electrodes 114 could be spaced 5 millimeters apart, while the electrodes 118 could be spaced 25 millimeters apart.

Although it is generally preferable to use upper and lower field directors 110, 112 which have evenly spaced, pointed electrodes 114, 118 to generate a substantially uniform electrostatic field, the particular structure of the upper and lower field directors 110, 112 is not considered important to the invention, and other structures could be used.

The spacing of the field directors 110, 112 (as shown in FIG. 3) could be varied, and the upper and lower field directors 110, 112 could be reversed, so that the field directors 110 are disposed below the web 90 and the field directors 112 are disposed above the web 90.

The use of the electrostatic cooler 58 has a number of advantages. When used after the dryer in a web-offset press, the number of chill rolls needed to reduce the temperature of the web may be reduced, saving substantial cost. Alternatively, it may be possible to eliminate the need for the chill rolls entirely via the use of an electrostatic cooler.

Also, the use of the electrostatic cooler 58 may reduce the cost of the dryer used to set the ink. A dryer used in a web-offset press typically has multiple dryer sections, each of which is typically heated to a different temperature. For example, the dryer may have a first dryer section into which the web passes that is heated to 260° F., a second dryer section which is heated to 280° F., and a third dryer section which is heated to 240° F. The use of the electrostatic cooler 58 adjacent a multi-section dryer may eliminate the need for the final dryer section, thus reducing the cost of the dryer significantly. In that case, the printing press 50 may include a dryer having only two sections, a first section heated to a first temperature of at least about 200° F. and a second section heated to a second temperature of about 200° F., the second temperature being different than the first temperature, and an electrostatic cooler connected directly adjacent the two-section dryer.

Figure 8:
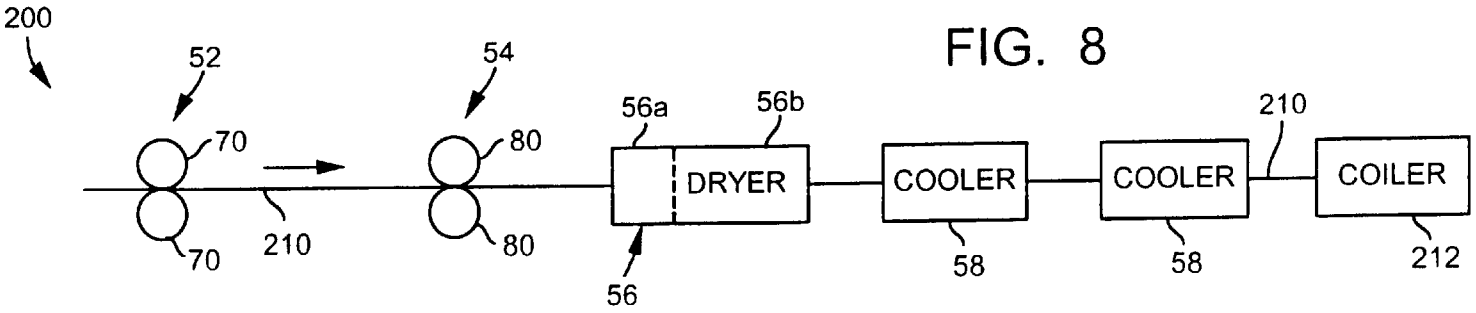
FIG. 8 illustrates an embodiment of a printing press with electrostatic cooling.

FIG. 8 illustrates an embodiment of a printing press 200 with electrostatic cooling. Referring to FIG. 8, the printing press 200 is provided with two or more printing stations 52, 54, which may be the same as described above in connection with the printing press 50 shown in FIG. 2, to print first and second images on a moving web 210 in ink, such as a heat-settable ink. The web 210 then passes into a drying apparatus, which may be the same as the drying station 56 described above, to heat the web 210 to set or dry the ink on the web 210. The drying apparatus 56 heats the web 210 to a temperature in excess of 200° F. or in excess of 250° F.

After being heated, the web 210 passes into one or more electrostatic coolers 58, which may be the same as the electrostatic cooling station 58 described above in connection with FIG. 3, to cool the web 210 to a temperature that may be not greater than about 150° F. or 130° F. Such cooling is accomplished exclusively by the electrostatic coolers 58 and does not require the use of any chill rolls 22, 60 or cooling apparatus of another type. The web 210 is then rolled up into a cylindrical roll by a coiler 212. There are no cooling devices disposed between the coiler 212 and the dryer 56, other than the electrostatic coolers 58, and only a single type of cooling device, i.e. electrostatic, is used between the dryer 56 and the coiler 212.

Although the printing press 200 is shown in FIG. 8 to include two electrostatic coolers 58, a greater or lesser number of electrostatic coolers 58 could be used, depending on the temperature to which the web 210 is heated by the dryer 56 and the desired final temperature of the web 210 when it exits the last cooler 58.

The size of the electrostatic coolers 58 could also be varied. For example, the electrostatic cooler 58 shown in FIG. 3 has a single row of spray nozzles 100, six upper field directors 110 and seven lower field directors 112. If the printing press 200 were to require two such electrostatic coolers 58 to provide the necessary cooling of the web 210, the cooling capacity of those two coolers 58 could be provided in the form of a single electrostatic cooling apparatus having two rows of nozzles 100 spaced apart in the longitudinal direction of the web 210, a greater number of upper field directors 110 and lower field directors 112 (not necessarily twice the number shown in FIG. 3), and a single cabinet that encloses the two rows of nozzles 100 and the field directors 110, 112.

Figure 9:
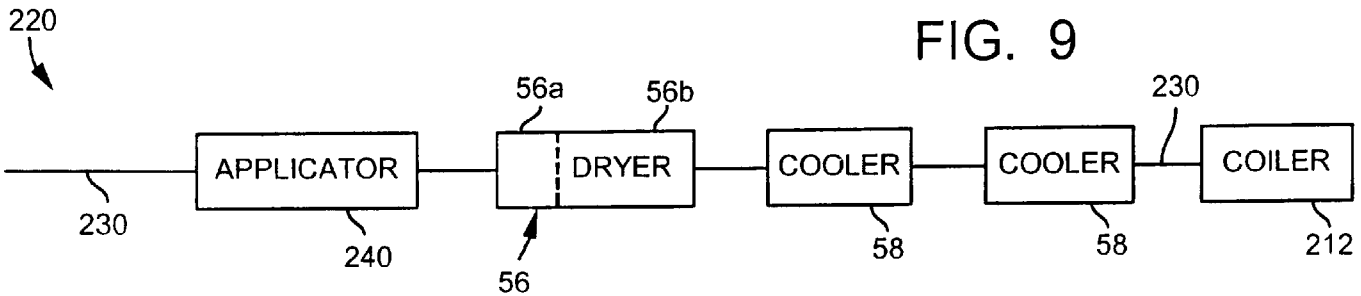
FIG. 9 illustrates an embodiment of a coating apparatus with electrostatic cooling.

FIG. 9 illustrates an embodiment of a coating apparatus 220 with electrostatic cooling. The coating apparatus 220 may be used to apply various coatings to a moving web 230, such as paper, for various purposes. The coating apparatus 220 shown in FIG. 9 is the same in structure and operation as the printing press 200 shown in FIG. 8, except that the coating apparatus 220 has an applicator apparatus 240 for applying a liquid material to the web 230 instead of the printing stations 52, 54 of the printing press 200.

Generally, the applicator apparatus 240 is different than the printing stations 52, 54 in that the applicator apparatus 240 may evenly apply a substantially uniform layer or coating of a liquid material to the web 230 that evenly covers most or all of the web 230, and does not generate two different images like the printing stations 52, 54.

The applicator apparatus 240 may be used to apply a liquid filling agent to the web 230. Such a filling agent, which is conventional, may be applied to paper or other webs produced from lower quality fibers and which have small voids formed therein that cause the web to have a relatively rough surface. The application of a filling agent, such as a clay-based filling agent, results in a web having a smoother surface.

The applicator apparatus 240 may be used to apply a liquid whitening agent to the web 230. A whitening agent, such as a bleaching agent, may be used on webs which have an off-white color due to the fibers from which they are composed. The application of a whitening agent may be done concurrently with the application of a filling agent of the type described above.

The applicator apparatus 240 may be used to apply a liquid adhesive to the web 230. Such an adhesive may be either a water-activated adhesive, such as the adhesive used on an envelope, or a contact-activated adhesive, such as used on a label. The adhesive may be applied as a coating that covers all or substantially all of the web 230, or it may be applied in a repeating pattern, via a printing roller or similar device.

The applicator apparatus 240 may be used to apply a liquid protective agent to the web 230. Such a protective agent, which is conventional, may be clear and/or colorless and may be applied to produce a protective coating on the web 230. Such protective coatings are commonly used on the covers of magazines.

The applicator apparatus 240 may be used to apply a liquid release agent to the web 230. Such a release agent, which is conventional and may be a silicone-based release agent, is typically used to provide a non-stick layer on webs that form the backing carrier on which adhesive-backed labels are carried. The non-stick release layer on the backing carrier allows the adhesive-backed label to be easily removed from the backing carrier and applied to another surface.

Although specific examples of the application of liquid agents has been described above, the applicator 240 could be used to apply other liquid agents for other applications.

Figure 11:
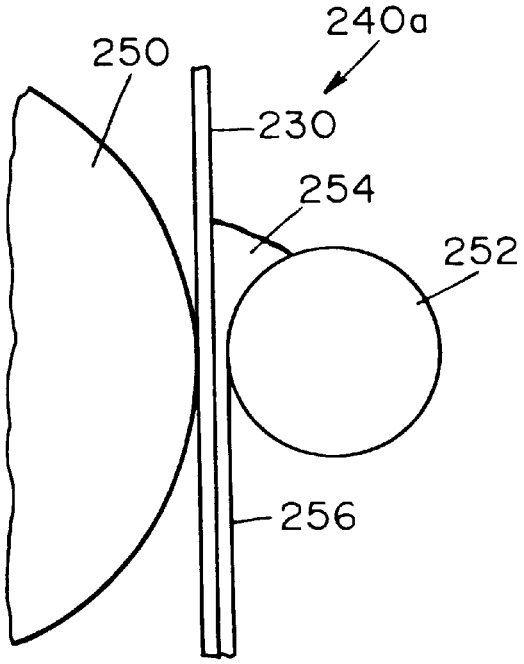
FIGS. 11–14 illustrate various liquid applicator devices.

The structure of the applicator apparatus 240 could take many different forms, four examples of which are shown in FIGS. 11–14. Referring to FIG. 11, the applicator 240 could be provided in the form of a metering-cylinder applicator 240*a*. The applicator 240*a* may include a rotatable support cylinder 250 having an axis of rotation and a rotatable metering cylinder 252 with an axis of rotation, the two axes of rotation being disposed in a plane perpendicular to the web 230. The metering cylinder 252 could rotate in the same or in the opposite direction as the support cylinder 250. An excess quantity of liquid agent 254 being applied by the metering cylinder 252 is disposed on the upstream side of the metering cylinder 252, and the metering cylinder 252 causes a substantially even, uniform coating 256 to be applied to the web 230.

Figure 12:
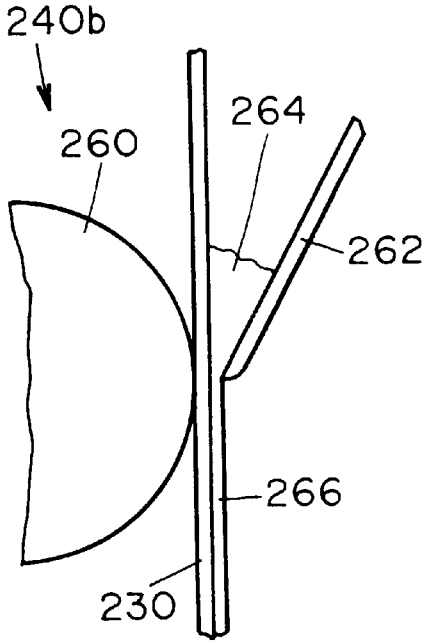

Referring to FIG. 12, the applicator 240 could be provided in the form of a metering-blade applicator 240*b*. The applicator 240*b* may include a rotatable support cylinder 260 and a metering blade 262 disposed at an angle relative to the web 230. An excess quantity of liquid agent 264 being applied by the metering blade 262 is disposed on the upstream side of the blade 262, and the metering blade 262 causes a substantially even, uniform coating 266 to be applied to the web 230.

Figure 13:
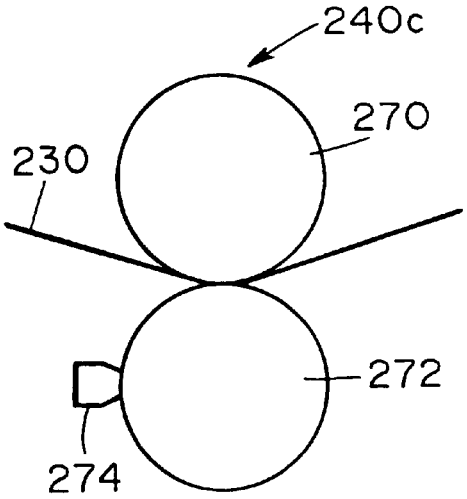

Referring to FIG. 13, the applicator 240 could be provided in the form of a gravure applicator 240*c*. The applicator 240*c*may include a first rotatable cylinder 270 and a rotatable gravure cylinder 272 having a uniform or non-uniform pattern of minute gravure cells (not shown) formed therein. Liquid material carried by an applicator device 274 is applied to the gravure cylinder 272 so as to fill the gravure cells with the liquid material. The liquid material in the gravure cells is then transferred to the web 230 when the cells make contact with the web 230.

Figure 14:
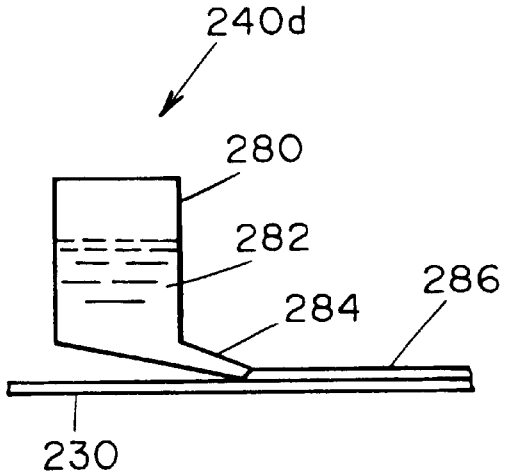

Referring to FIG. 14, the applicator 240 could be provided in the form of an extrusion head coating device 240*d*. The coating device 240*d* may have a pressurized liquid reservoir 280 with a liquid agent 282 disposed therein and a spray nozzle 284 through which the liquid agent 282 is sprayed onto the web 230 to form a continuous, even coating 286 on the web 230.

The components of FIGS. 11–14 are not necessarily shown to scale, and the thickness of the webs and coatings are shown exaggerated for purposes of explanation. The applicator apparatuses 240*a*, 240*b* of FIGS. 11 and 12 may be suitable for more viscous liquid agents. Other applicator apparatuses may also be used to apply a liquid agent to the web 230.

Figure 10:
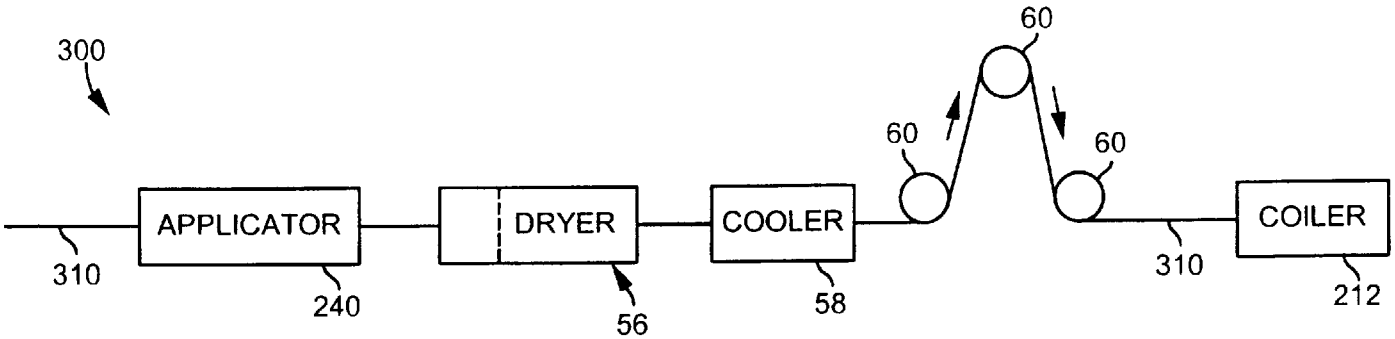
FIG. 10 illustrates another embodiment of a coating apparatus with electrostatic cooling.

FIG. 10 illustrates an embodiment of a coating apparatus 300. The coating apparatus 300 may be used to apply various coatings to a moving web 310, such as paper, for various purposes as described above. The coating apparatus 300 shown in FIG. 10 is the same in structure and operation as the printing press 50 shown in FIG. 2, except that the coating apparatus 300 has an applicator apparatus 240 for applying a liquid material to the web 310 instead of the printing stations 52, 54 of the printing press 50 and includes the coiler 212. Any of the applicator devices 240*a*, 240*b*, 240*c*, 240*d* described above may be used as the applicator 240 shown in FIG. 10, and the applicator 240 shown in FIG. 10 may be used to apply any of the liquid agents described above.

Figure 15:
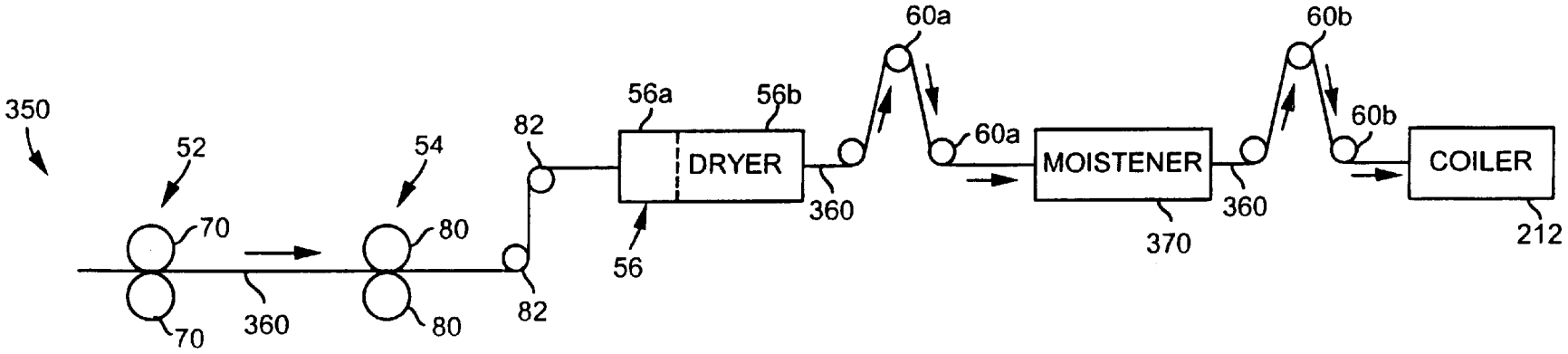
FIG. 15 illustrates an embodiment of a printing press with electrostatic moistening.

FIG. 15 illustrates an embodiment of a printing press 350 that is used to process a moving web 360. Referring to FIG. 15, the printing press 350 includes a first printing station 52 having a pair of printing cylinders 70, a second printing station 54 having a pair of printing cylinders 80, a plurality of guide rollers 82, and a dryer 56, all of which are described above and which operate in the same manner as described above.

When the web 360 exits the dryer 56, the web 360 has a temperature in excess of 250° F. and a moisture content of no greater than about 1.5%, and typically about 1%. In the printing press 350, an initial set of one or more chill rolls 60*a*, which are the same as the chill rolls 60 are described above, is disposed after the dryer 56 to cool the web 360 to a reduced temperature, which may be no greater than about 210° F. and not less than about 100° F.

An electrostatic moistener 370 is disposed after the chill rolls 60*a*. The electrostatic moistener 370 may have the same structure as the electrostatic cooler 58 shown in FIG. 3 and described above. The electrostatic moistener 370 is used to increase the moisture content of the web 360 from about 1–1.5% to about 2.5–5%. The water sprayed onto the web 360 by the electrostatic moistener 370 causes the moisture content of the web 360 to increase because the temperature of the web 360 is not substantially greater than 212° F., which is the boiling point of water.

The inventors have realized that, if the electrostatic apparatus 370 were used to spray water onto the web 360 when the temperature of the web 360 was higher than 212° F., water sprayed onto the web 360 would simply boil off of the web 360 without causing any significant increase in the moisture content of the web 360. The inventors have also realized that, more uniform moistening of the web 360 is provided if the web 360 is sprayed with water when the temperature of the web 360 is at least about 100° F. and when the temperature of the web caused at least some evaporation of the sprayed water.

A second set of chill rolls 60*b* is disposed after the moistener 370. The chill rolls 60*b*, which may be the same as the chill rolls 60 described above, cause the temperature of the web 360 to be further reduced, by at least about 20° F. or at least about 50° F., so that the final temperature of the web 360 is no greater than about 100° F.

Figure 16:
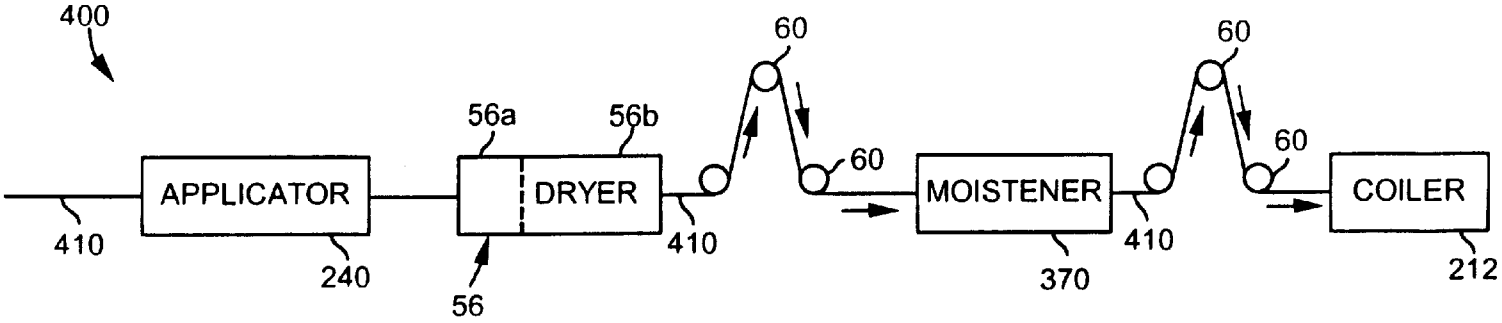
FIG. 16 illustrates an embodiment of a coating apparatus with electrostatic moistening.

FIG. 16 illustrates an embodiment of a coating apparatus 400. The coating apparatus 400 may be used to apply various coatings to a moving web 410, such as paper, for various purposes as described above. The coating apparatus 400 shown in FIG. 16 is the same in structure and operation as the printing press 350 shown in FIG. 15, except that the coating apparatus 400 has an applicator apparatus 240 for applying a liquid material to the web 410 instead of the printing stations 52, 54 of the printing press 350. Any of the applicator devices 240*a*, 240*b*, 240*c*, 240*d* described above may be used as the applicator 240 shown in FIG. 16, and the applicator 240 shown in FIG. 16 may be used to apply any of the liquid agents described above.

The application from which this patent issued was filed in the Patent Office on the same day as an application entitled "Web Processing With Electrostatic Cooling," inventors Steven Siler and David Klein, which application is incorporated herein by reference in its entirety.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An apparatus, comprising:

an applicator apparatus that applies a liquid material to a moving web, said liquid material being applied evenly to said web by said applicator apparatus to create a substantially uniform coating of said liquid material on said web;

a drying apparatus that heats said liquid material applied to said web by said applicator apparatus, said web being at an initial temperature of greater than about 250° F. when said web passes out of said drying apparatus, said web having a moisture content of no greater than about 1.5% when said web passes out of said drying apparatus;

a first cooling apparatus disposed after said drying apparatus, said first cooling apparatus causing said initial temperature of said web to be reduced to a second temperature no greater than about 210° F. and no less than about 100° F.;

a moistening apparatus disposed after said first cooling apparatus, said moistening apparatus receiving said web after said web has been cooled by said first cooling apparatus and when said web has a temperature of between about 210° F. and 100° F., said moistening apparatus causing said moisture content of said web to be increased to at least about 2.5%, said moistening apparatus comprising:

a generator adapted to generate a directed electrostatic field through which said web passes; and a sprayer adapted to spray liquid onto said web to moisten said web, said electrostatic field causing said liquid to pass through a confined path between said sprayer and said web; and a second cooling apparatus disposed after said moistening apparatus, said second cooling apparatus causing said web to be cooled to a temperature not greater than about 100° F.

2. An apparatus as defined in claim 1 wherein one of said cooling apparatuses comprises at least one chill roll that makes physical contact with said web.

3. An apparatus as defined in claim 1 wherein said sprayer comprises a plurality of spray nozzles disposed in a direction transverse to a longitudinal axis of said web.

4. An apparatus as defined in claim 1 wherein said moistening apparatus additionally comprises a cabinet for substantially enclosing said generator and said sprayer.

5. An apparatus as defined in claim 1 wherein said generator comprises:

a plurality of first field directors disposed on a first side of said web, each of said first field directors having a plurality of electrodes;

a plurality of second field directors disposed on a second side of said web opposite said first side, each of said second field directors having a plurality of electrodes; and a voltage supply that supplies a relatively high voltage to said electrodes of one of said first or second field directors.

* * * * *